United States Patent [19]

Nishimura et al.

[11] 3,934,400

[45] Jan. 27, 1976

[54] ELECTRONIC TIMEPIECE

[75] Inventors: Izuhiko Nishimura, Suwa; Shinji Morozumi, Shimosuwa, both of Japan

[73] Assignee: Kabushiki Kaisha Suwa Seikosha, Tokyo, Japan

[22] Filed: May 13, 1974

[21] Appl. No.: 469,490

[30] Foreign Application Priority Data

May 11, 1973 Japan ..... 48-52344

[52] U.S. Cl. ..... 58/23 R; 58/39.5

[51] Int. Cl.[2] ..... G04C 3/00

[58] Field of Search ..... 58/23 R, 23 A, 50 R, 21.13, 58/21.14, 22.9, 39.5, 85.5

[56] References Cited

UNITED STATES PATENTS 3,757,509 9/1973 Fujita ..... 58/23 R 3,795,099 3/1974 Tsuruishi ..... 58/50 R

*Primary Examiner*—L. T. Hix

*Assistant Examiner*—U. Weldon

*Attorney, Agent, or Firm*—Blum, Moscovitz, Friedman & Kaplan

[57] ABSTRACT

A chronographic electronic timepiece adapted to display elapsed time wherein the time displayed is rounded off to the nearest half period is provided. Chronographic divider stages adapted to apply signals representative of elapsed time to associated display elements include a binary divider stage adapted to produce elapsed time signal having a period which is the longest time period not displayed by said display elements. A rounding off circuit is provided for advancing the period counted by the binary divider stage in order to advance the count thereof by half a period to effect a rounding off of the time displayed by the display elements.

7 Claims, 10 Drawing Figures

ELECTRONIC TIMEPIECE

BACKGROUND OF THE INVENTION

The invention relates to an electronic timepiece and in particular to circuitry for rounding off the elapsed time displayed by a chronographic electronic timepiece. Heretofore, when chronographic electronic timepieces were utilized as stop watches to measure elapsed time, the accuracy of such chronographic timepieces was impaired by the failure to take into account the time period below the smallest period displayed, i.e., hundreths of a second where tenths of a second are displayed. In order to overcome this disadvantage, and render such chronographic timepiece more accurate, it is necessary to round off elapsed time displayed by advancing each period displayed by one-half the period of the longest time period not displayed to effect an accurate display of elapsed time.

SUMMARY OF THE INVENTION

Generally speaking, in accordance with the invention, a chronographic timepiece adapted to round off the longest period prior to the period displayed by the timepiece is provided. The chronographic timepiece includes an oscillator means adapted to produce a time standard signal. A chronographic divider means including a plurality of series-connected divider stages, each said divider stage being adapted to count elapsed time and produce an output signal representative of elapsed time. Digital display means including a plurality of display elements is provided. A group of the last of the series-connected divider stages producing elapsed time signals for display, each of said elapsed time signals for display being respectively associated with a display element for displaying the elapsed time counted thereby. The chronographic divider means includes a binary divider stage immediately in advance of the divider stages producing the displayed elapsed time signals. A rounding off circuit is coupled to the binary divider stage, the rounding off circuit advancing the count produced by said binary divider stage by half a period to thereby round off the elapsed time displayed by the display elements.

Accordingly, it is an object of this invention to provide an improved chronographic electronic timepiece adapted to provide more accurate time display.

It is another object of the instant invention to provide an improved chronographic electronic timepiece adapted to digitally display either actual time or elapsed time.

Still another object of this invention is to provide an electronic chronographic timepiece adapted to automatically round off the digits below the digital displayed during chronographic display.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
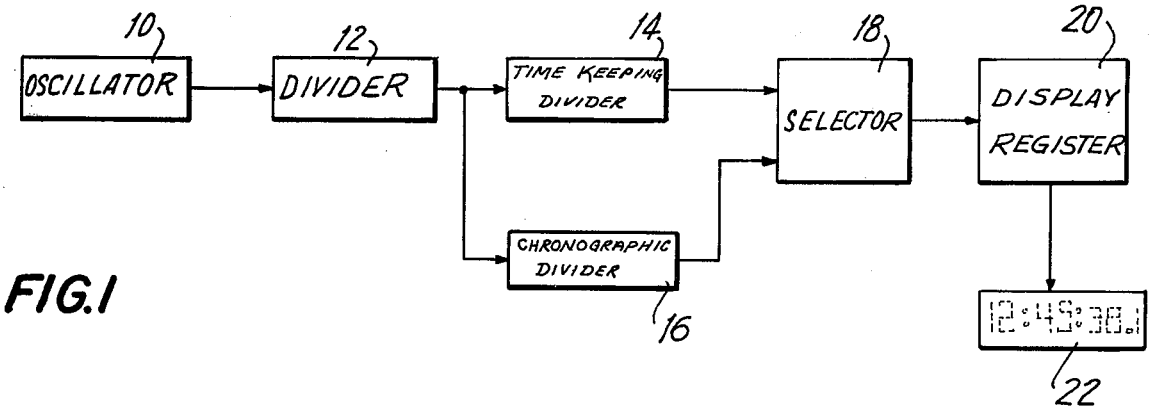
FIG. 1 is a block circuit diagram of an electronic timepiece adapted to display actual time and/or elapsed time and constructed in accordance with the instant invention.
Figure 2:
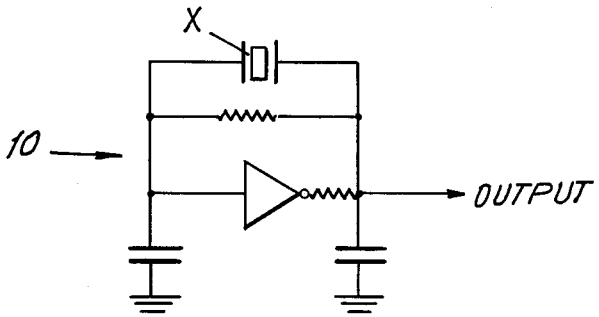
FIG. 2 is a circuit diagram of the oscillator circuit depicted in FIG. 1.
Figure 3:
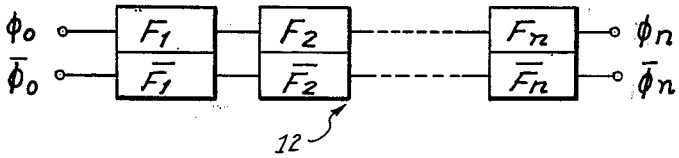
FIG. 3 is a block circuit diagram of the divider circuit 12 depicted in FIG. 12.

Referring now to FIG. 1, an electronic timepiece circuit is depicted therein. An oscillator circuit 10, more particularly illustrated in FIG. 2, includes a quartz crystal vibrator X for producing a high frequency time standard signal at the output of the oscillator circuit 10. Divider circuit 12 produces a lower frequency standard signal in response to the high frequency divider signal provided by the quartz crystal oscillator circuit 10. The divider circuit 12, as is particularly illustrated in FIG. 3 by way of example, is comprised of a plurality of series connected binary divider stages $F_1$, $F_1$ through $F_n$, $F_n$. A timekeeping divider circuit 14 and chronographic divider circuit 16 respectively produce timekeeping signals representative of actual time and chronographic signals representative of elapsed time in response to the lower frequency timekeeping signals produced by the divider circuit 12.

Figure 10:
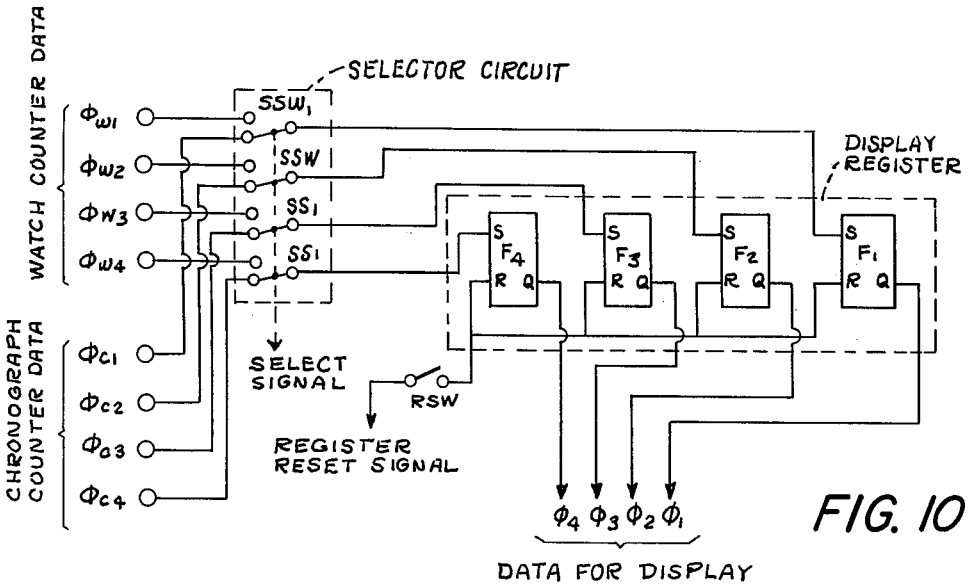
FIG. 10 is a circuit diagram of the selector circuit depicted in FIG. 1.

The actual time counted by timekeeping circuit 14 and the elapsed time counted by the chronographic circuit 16 are applied to a display register 20 by a selector circuit 18 adapted as shown in FIG. 10, to select the timing signals counted by either the chronographic divider circuit 16 or the timekeeping divider circuit 14 to be supplied to said display register. The display register 20 applies the signals stored therein to a digital display 22 which includes a decoder circuit and plurality of digital display elements adapted to provide a digital display of each of the signals stored in display register 20.

Figure 4:
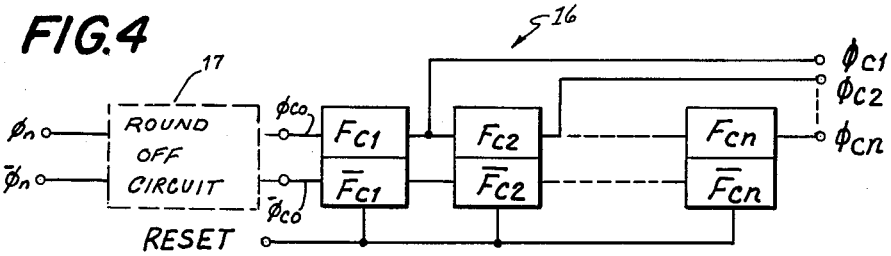
FIG. 4 is a block circuit diagram of the chronographic divider circuit and round off circuit utilized in the chronographic timepiece depicted in FIG. 1.

Reference is now made to FIG. 4, wherein a plurality of series-connected binary divider stages define a divider circuit suitable for use as chronographic time divider circuit 16, and a round off circuit 17. The chronographic divider circuit 16 is formed from a plurality of flip-flop circuits adapted to receive low frequency divider signals $0_{CO}$, $0_{CO}$ from the round off circuit 17 and produce elapsed time output signals $0_{C1}$ through $0_{CN}$ in response to the elapsed time counted thereby. A RESET terminal is coupled in common to each of said divider stages $F_{C1}$, $F_{C1}$ through $F_{CN}$, $F_{CN}$ to allow each of the divider stages to be reset to a certain state to thereby allow said chronographic divider stages to begin counting from zero at any specific time to perform the desired stop watch function.

Figure 5:
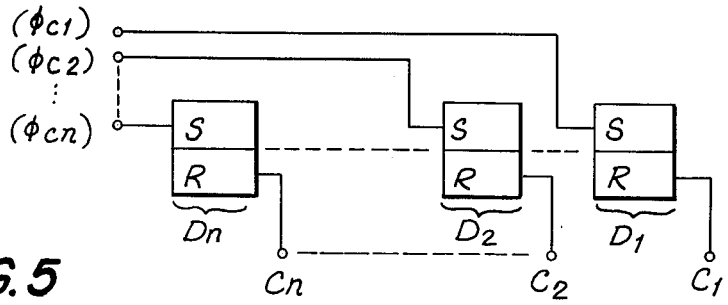
FIG. 5 is a circuit diagram of the display register illustrated in the electronic timepiece depicted in FIG. 1.

Referring now to FIG. 5, a detailed circuit diagram for the display register 20 is depicted. The display register 20 is formed of a plurality of set-reset flip-flop stages $D_1$ through $D_n$. Either elapsed time signals $0_{C1}$ through $0_{CN}$ of the chronographic divider 16 or the actual time signals from the timekeeping divider circuit 14 are supplied through selector circuit 18 to the display register circuit 20 wherein they are transformed into signals adapted to drive the display cells 22. Accordingly, if a switch is provided externally of the watch, and is coupled to selected 18, either a timekeeping or chronographic function can be selected and actual time or elapsed time written into the display register in a side by side manner. The display register in turn supplies the data stored therein to display 22.

Display 22 includes a decoder circuit for decoding the signals applied thereto from the display register and providing signals for driving a plurality of digital display elements formed from liquid crystals and/or light emitting diodes. Each digital display element is associated with a divider stage in said timekeeping divider circuit and a divider stage in said chronographic divider circuit, to thereby display the time signals counted thereby.

In operation, when the digital display displays actual time counted by the timekeeping divider circuit 14, the digits counted below the lowest digit to be displayed are only utilized as counting signals. Accordingly, if the display had six digits, namely hours (2 digits), minutes (2 digits) seconds (2 digits), then divider stage counting the longest period of the signals not displayed, namely, tenths of seconds would not be displayed but would still be essential in providing counting signals. Similarly, when elapsed time is counted by the chronographic divider circuit 16, the state of the divider stages counting elapsed time having a period below the lowest time period to be displayed is not displayed, but in this case is significant if an accurate time period is required. This is so because the accuracy of a chronograph time period when utilized as a stop watch to measure elapsed time is more critical. Thus, if the same six digit display is utilized as above, then such a chronograph is only capable of measuring accuracy to one second. Moreover, if the elapsed time counted by the timepiece were actually 1 hour, 1 minute, 259/10 seconds, (01:01:25.9), because there are only six display elements available to display the elapsed time, the display would read 1 hour, 1 minute, and 25 seconds (1:01:25) which is not accurate since the actual time elapsed is closer to 1 hour, 1 minute, and 26 seconds (1:01:26).

Figure 9:
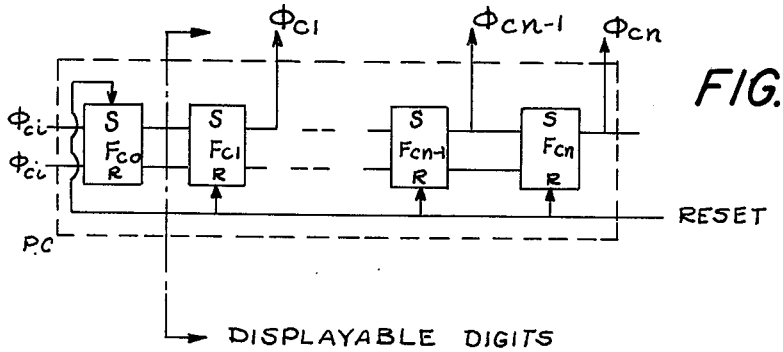
FIG. 9 is a circuit diagram of an alternative embodiment of the chronographic divider circuit and round off circuit utilized in the chronographic timepiece depicted in FIG. 1.

Accordingly, in order to render the elapsed time displayed more accurate, a rounding off circuit is provided for automatically rounding off the digits displayed by advancing same when the digit representative of the largest time period not displayed is one-half or greater. Reference is made to FIG. 9 wherein such rounding off circuit is depicted. By adding one half to the signal counted by the divider stage producing an elapsed time signal having the largest period not displayed, rounding off is automatically effected once the counting of the elapsed time is begun. One way of achieving such a result, where the binary divider stages normally start their count at a state of one, is to reset to zero the divider stage corresponding to the longest time period not displayed and setting to one all the others when the elapsed time measurement is begun at the beginning of the time period to thereby effect a rounding off of the signal displayed by the electronic timepiece. It is noted that such a rounding off would not require round off circuit 17 but instead would merely require a reset or set to zero of the binary divider stage producing elapsed time signal having the largest period not displayed.

Figure 6:
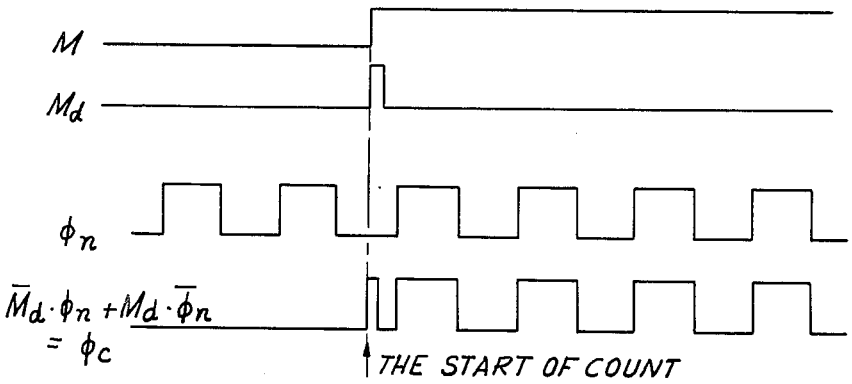
FIG. 6 is a timing chart representative of the manner in which rounding off can be achieved in accordance with an alternative embodiment of the instant invention.

Reference is now made to FIG. 6, wherein still another type of rounding off is achieved in accordance with the instant invention by adding a count of one half to binary divider $F_{C1}$, $F_{C1}$. A differential signal $M_D$ is formed from signal M at the starting time of the count by the actuation of a manually operated start switch (not shown), the input $0_{CO}$, $0_{CO}$ to the counter being derived by the rounding off circuit 17 from the output signal $0_n$, $0_n$ of divider circuit 12 and differential signal $M_D$. A rounding off circuit 17 capable of producing differential signal $M_d$ could be comprised of a MOSFET switch in combination with a differential amplifier or any other well known switching or differentiating device of the prior art. As is clearly illustrated in FIG. 6, prior to beginning the counting of elapsed time, all the divider stages are reset to zero. Accordingly, the differential signal $M_D$ is mixed with the signal applied to the divider stage producing the elapsed time signal having the largest time period not displayed, and the divider stage is set from a zero state to a one state at a time one half period earlier. As is detailed in FIG. 6, an advance of each subsequent divider stage by one-half the period of the highest frequency divider stage not displayed is effected. Accordingly, the digital display will be automatically rounded off at the start of count of elapsed time and will continue to be rounded off thereafter.

Figure 7:
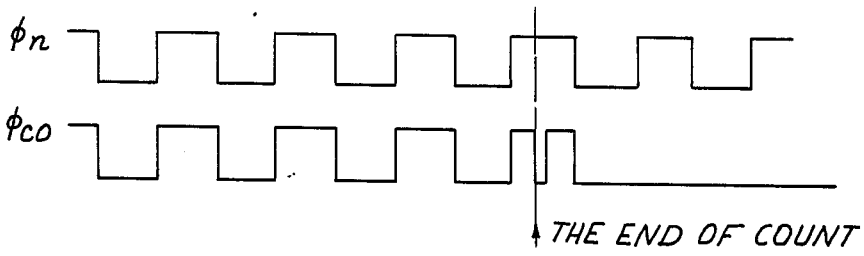
FIG. 7 is a timing chart of still another manner in which rounding off can be achieved in accordance with still another embodiment of the instant invention.

In accordance with the above noted rounding off process, it is also possible to utilize a rounding off circuit 17 to round off the elapsed time counted at the end of the count of elapsed time. An illustration of such rounding off is depicted in FIG. 7 and requires the application of a differential pulse $M_D$ at the end of the count actuated by the stopping of the count, as by a manual stop switch (not shown). Such a signal would be mixed with the $0_n$, $0_n$ signals from divider 12 in rounding off circuit 17 to produce $0_{CO}$, $0_{CO}$ as shown in FIG. 7, to cause the binary divider stage producing the output signal having the longest period not displayed (stage $F_{C1}$, $F_{C1}$) to effect a change of states in the elapsed time signal counted thereby. If the elapsed count of stage $F_{C1}$, $F_{C1}$ is in its first half cycle such change of states has no effect of the next stage. If the elapsed count of stage $F_{C1}$, $F_{C1}$ is in the second half cycle, the state of the next stage $F_{C2}$, $F_{C2}$ is changed to thereby effect a rounding off of the signal displayed at the end of the count of the elapsed time.

It is understood, that when the aforedescribed rounding off methods are utilized the display register 20 is adapted to supply elapsed time signals from the chronographic divider circuit to the display 22 which signals are advanced by one half the period of said earlier divider stage. However, it is also possible to advance the non-rounded off elapsed time signals supplied to the display register by one-half after the signals are counted by the chronographic divider circuit and applied to the display register.

Figure 8:
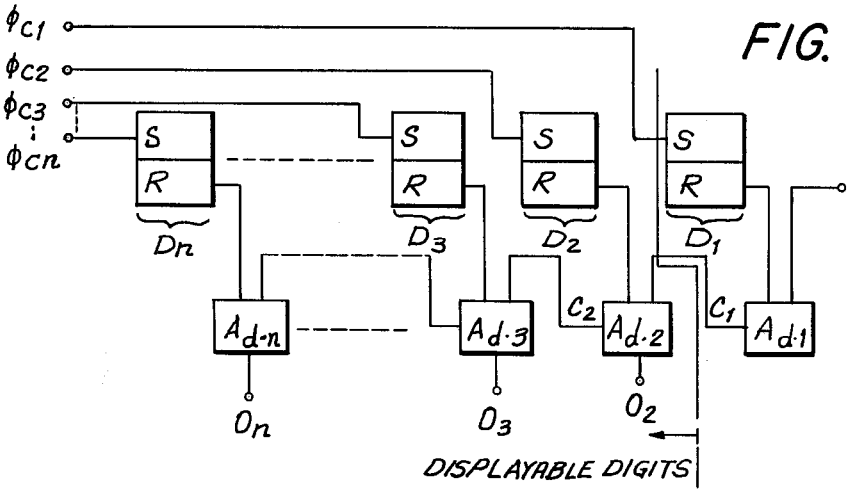
FIG. 8 is a block circuit diagram of an alternative embodiment of the instant invention wherein the display register is utilized to effect rounding off of the time displayed in accordance with the instant invention

Referring specifically to FIG. 8, the display register illustrated therein is suitable for achieving rounding off of the elapsed time signals. As is depicted in FIG. 8, a pulse, produced by a divider stage immediately in advance of the divider stages producing chronographic signal $0_{C1}$ $0_{CN}$ to be displayed is added to the input of the adder $A_{d-1}$ of the register $D_1$ corresponding to the largest period not displayed to thereby add one half thereto and supply a carry signal to the input of the next adder $A_{d-2}$ which correspond to the first digit to be displayed. Thus each register is connected by means of an adder $A_d$ and the carry signal provides the advance counting. Accordingly, the unavailable digit not to be displayed can be utilized to automatically effect a rounding off of the lowest displayable digit when processing a digit such as 1/10,000 second or 1/100 second when time is being counted by a stop watch to thereby effect a more accurate display of measured time thus yielding an improved chronograph timepiece.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of lanugage, might be said to fall therebetween.

What is claimed is:

1. An electronic timepiece including oscillator means for producing a high frequency time standard signal; multi-stage chronographic divider means electrically coupled to said oscillator means for receiving said high frequency time signal and counting elapsed time in response thereto, a group of the last of said chronographic divider means stages being adapted to produce elapsed time signals for display said chronographic divider means including a binary divider stage immediately in advance of said group of chronographic divider means stages for producing a rounding off signal; digital display means including a plurality of digital display elements for the display of elapsed time, each display element respectively corresponding to one of said elapsed time signals from said group of chronographic divider means stages, said digital display means further including a plurality of display register means, each display register means receiving one of said elapsed time signals to be displayed, and one further display register means adapted to receive said rounding off signal and a plurality of series-connected rounding off means, each of said rounding off means being coupled to one of said display registers, said rounding off means being adapted to advance the count of said elapsed time signals received by said display register means by half the period of the rounding off signal counted by said binary divider stage to thereby round off the elapsed time displayed by said display elements.

2. An electronic timepiece as claimed in claim 1, wherein each said rounding off means includes means for adding a carry signal to each of said display registers to advance the time stored therein by half the period of the rounding off signal.

3. An electronic timepiece as claimed in claim 1, and including timekeeping divider means for receiving the high frequency time standard signal from said oscillator means and producing timekeeping signals representative of actual time in response thereto, and selector means are provided, said selector means being adapted to receive said actual timekeeping signals counted by said timekeeping divider means and said elapsed time signals counted by said chronographic divider means, said selector circuit selecting one of said actual time signals or elapsed time signals to be supplied to said display means for display thereby.

4. In an electronic timepiece including oscillator means for producing a high frequency time standard signal and first divider means electrically coupled to said oscillator means and adapted to produce an intermediate frequency time standard signal in response to said high frequency time standard signal, the improvement comprising chronographic divider means coupled to said intermediate divider means and adapted to produce low frequency chronographic signals representative of elapsed time in response to said intermediate frequency time standard signal, said chronographic divider means including a plurality of series-connected divider stages, said divider stages being adapted to count signals representative of elapsed time and to produce elapsed time signals representative of a selected number of digits of time; timekeeping divider means coupled to said first divider means and adapted to produce low frequency signals representative of present time in response to said intermediate frequency time standard signal; selector circuit means coupled to said chronographic divider means for receiving said chronographic signals and to said timekeeping divider means for receiving said timekeeping signals, said selector circuit means having an output to which one of said chronographic signals and timekeeping signals are selectively applied; digital display means coupled to the output of said selector circuit means for displaying either an elapsed or present time depending on the signals supplied by said selector circuit means; and rounding off means associated with said chronographic divider means and electrically coupled to said divider stage producing the highest undisplayed digit of elapsed time to effect an advance of the count thereof by one half of the period of the count thereof and therefore a rounding off of the elapsed time displayed by said display means.

5. In an electronic timepiece including oscillator means for producing a high frequency time standard signal, the improvement comprising chronograph divider means electrically coupled to said oscillator means and including a plurality of series-connected divider stages for counting signals representative of elapsed time in response to said high frequency time standard signal, a group of the last of said series-connected divider stages producing elapsed time signals for display, said chronographic divider means also including a binary divider stage immediately in advance of the divider stages producing the displayed elapsed time signals for digital display, digital display means including a plurality of digital display elements, said display means being coupled to said group of the last of said plurality of series-connected divider stages so that each said display element respectively displays the elapsed time counted by a respective divider stage; and rounding off means coupled to said binary divider stage, said rounding off means being adapted to advance the count of said binary divider stage by half the period of the elapsed time signal counted by said binary divider stage to thereby round off the elapsed time displayed by said display elements.

6. In an electronic timepiece as claimed in claim 4, wherein said rounding off means includes reset means coupled to said binary divider stage and to said group of the last of said plurality of series-connected divider stages, said reset means being adapted to reset the binary divider stage to a first binary state at the beginning of the count of elapsed time and to reset said group of the last of said plurality of series-connected divider stages to the other binary state at the beginning of the count of elapsed time to thereby effect an advance of the count of said elapsed time signals by half the period of the elapsed time signal counted by said binary divider stage.

7. An electronic timepiece as claimed in claim 4, and including timekeeping divider means for receiving said high frequency time standard signal from said oscillator means and producing timekeeping signals representative of actual time in response thereto, and selector means adapted to receive said actual timekeeping signals counted by said timekeeping divider means and said elapsed time signals counted by said chronographic divider means, said selector circuit selecting one of said actual time signals or elapsed time signals to be supplied to said display means for display thereby.

* * * * *